United States Patent [19]

May

[11] Patent Number: 4,997,404

[45] Date of Patent: Mar. 5, 1991

[54] TOY VEHICLE SOUND SYSTEM

[76] Inventor: Richard L. May, 816 Duncan Pl., Manhattan Beach, Calif. 90266

[21] Appl. No.: 446,807

[22] Filed: Dec. 6, 1989

[51] Int. Cl.[5] ..... A63H 17/34

[52] U.S. Cl. ..... 446/409

[58] Field of Search ..... 446/409, 410, 411, 414

[56] References Cited

U.S. PATENT DOCUMENTS

| | | | |
|---|---|---|---|
| 1,893,897 | 1/1933 | Hummer | 446/409 |
| 2,978,836 | 4/1961 | Kato | 446/409 |
| 3,061,973 | 11/1962 | Oberdorf | 446/409 |
| 3,165,860 | 1/1965 | Glass et al. | 446/414 |
| 3,425,156 | 2/1969 | Field | 446/409 |
| 3,591,977 | 7/1971 | Disko et al. | 446/409 |
| 3,600,848 | 8/1971 | Marshall | 446/410 |
| 4,219,962 | 9/1980 | Levy et al. | 446/409 |
| 4,813,907 | 3/1989 | Rissman et al. | 446/175 |

*Primary Examiner*—Mickey Yu

[57] ABSTRACT

A toy vehicle incorporating a sound effect generator similar to an acoustical phonograph having a machined turntable with mutually exclusive sound tracks, each of the sound tracks creating a different sound effect through a tone arm and speaker cone arrangement. The turntable is driven by a gear train from the wheels of the vehicle. Selection of the various sound effects is made by movement of the vehicle in response to the normal forces of the play pattern on the vehicle causing the tone arm to engage different ones of the sound tracks.

4 Claims, 3 Drawing Sheets

TOY VEHICLE SOUND SYSTEM

BACKGROUND OF THE INVENTION

Toy vehicles that produce simulated sound effects in order to enhance the play of the toy are well known. As pointed out in U.S. Pat. No. 4,219,962, for example, toy vehicles including mechanical sound generators driven by the vehicle motor are described in U.S. Pat. Nos. 3,190,034; 3,391,489; and 3,441,236. Similarly, model train engines often include means for simulating the sounds of locomotives, such as described in U.S. Pat. Nos. 3,664,060 and 3,466,797. Such prior art sound generators include, for example, switching devices which cooperate with the toy drive mechanism or steering mechanism selectively to apply various voltages to diaphragm-type signalling devices for the purpose of producing the various sound effects. Other toys, such as described in U.S. Pat. No. 3,160,983 generate sound effects only during periods when the toy is turning.

The sophistication of the prior art products range from the simple clicker unit which comprises a pointed wheel cam on an axle which flexes a resilient member and then allows the member to snap back against a sound producing surface, to highly sophisticated and costly units, such as the electronic unit described in U.S. Pat. No. 4,219,962.

The present invention is concerned with a sound generator to be mounted on a toy vehicle to simulate certain sound effects. The sound generator of the invention is similar to an acoustical phonograph, and it includes a machined turntable with mutually exclusive concentric sound tracks, each of the sound tracks creating a different sound effect as it is engaged by the needle of a tone arm/speaker subassembly. The turntable is driven, for example, by a gear train coupled to the wheels of the vehicle. Selection of the various sound effects in the generator of the present invention is made in the following manner: when the vehicle is pushed straight ahead the sound generator creates a motor sound as the tone arm needle is positioned on the "motor noise" track, pushing the vehicle faster makes the motor sound faster; when the vehicle is pushed while biasing the pushing force to the right or left causes an appropriate linkage to move the tone arm needle to a "squealing tires" track; finally, when the vehicle is pushed against a movable object the front bumper is displaced back towards the center of the vehicle, and this causes the tone arm needle to be moved to a "crash" track on the turntable to simulate crash sounds.

It is evident that additional and/or different sound tracks may be used to simulate, for example, horn or siren sounds, backfiring engine sounds, gear shifting sounds, and the like.

In the embodiment to be described, no exterior levers are utilized, so that the sound effects coincide with the natural play of the vehicle, making the overall effect extremely natural and simple. In the embodiment to be described, no batteries are used, so that there is no danger to the child playing with the vehicle and no continuing maintenance cost to the parent.

DETAILED DESCRIPTION OF THE ILLUSTRATED EMBODIMENT

Figure 1:
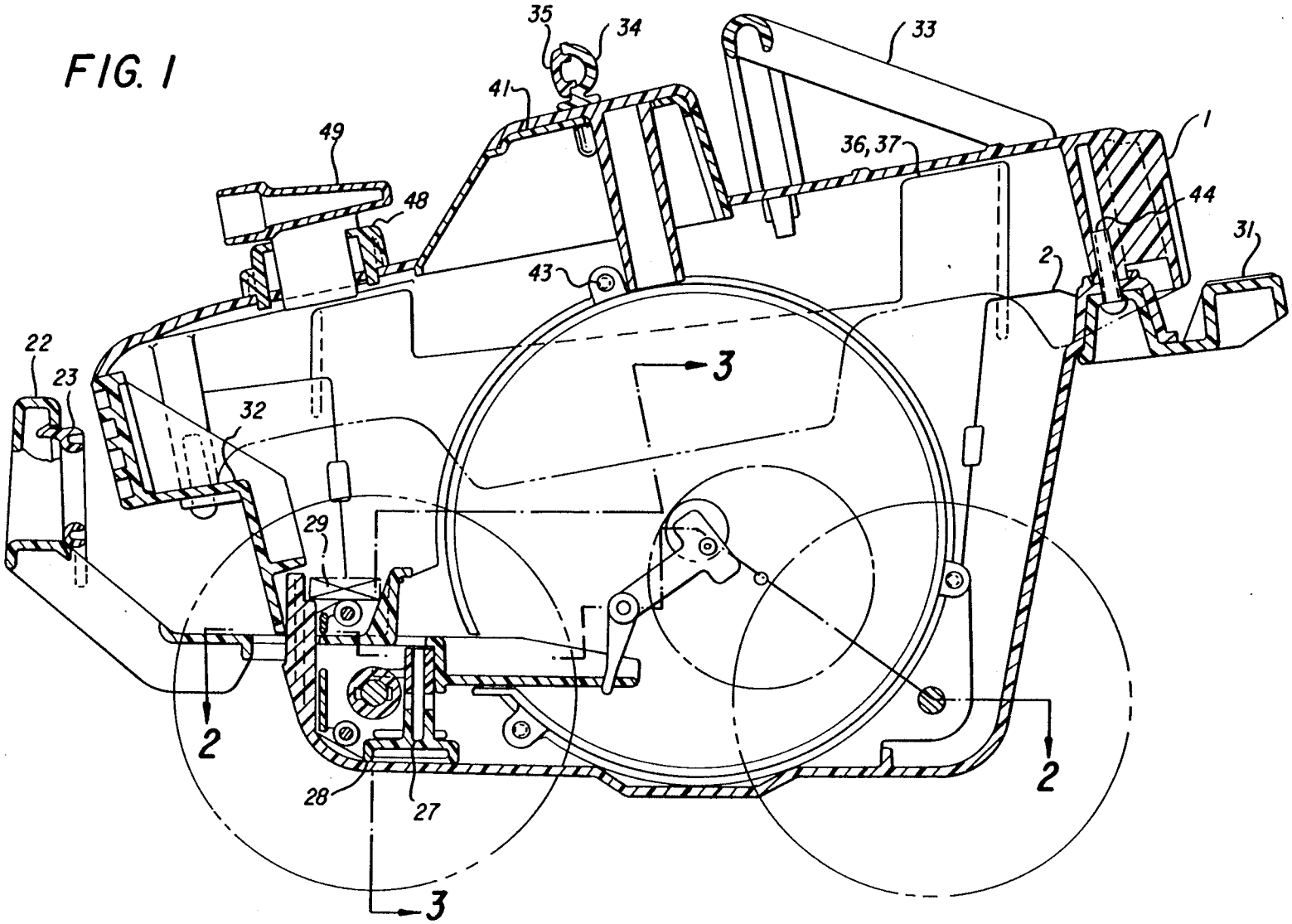
FIG. 1 is a side sectional view of a vehicle in the form of a toy truck representing one embodiment of the invention taken essentially at the centerline of the vehicle.
Figure 2:
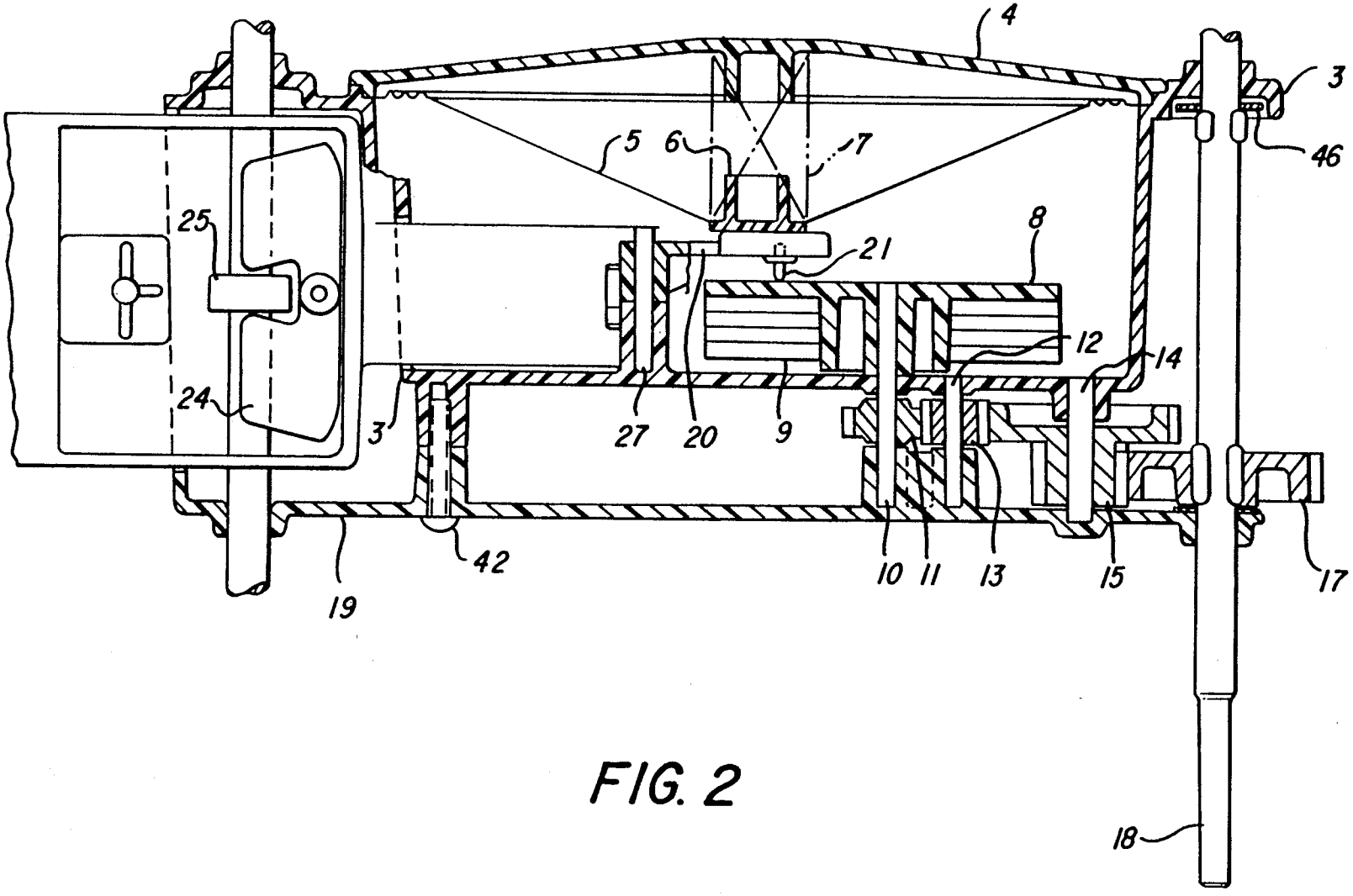
FIG. 2 is a sectional view taken along the line 2—2 of FIG. 1.
Figure 3:
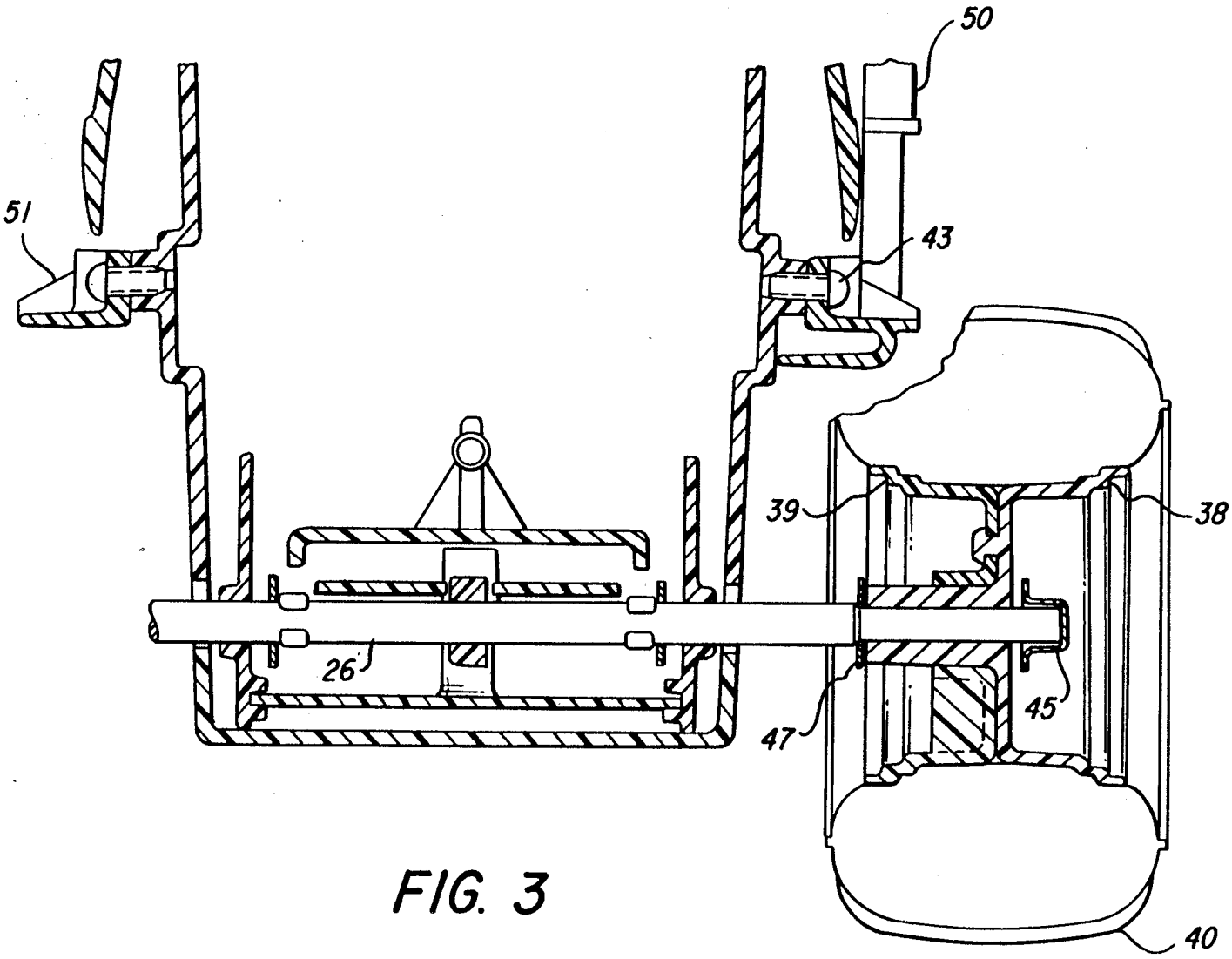
FIG. 3 is a sectional view taken along the line 3—3 of FIG. 1.

As shown in FIGS. 1-3, the illustrated vehicle is a truck comprising a chassis 2 whose right side is designated 36 and left side is designated 37, and a chassis 1. The truck also comprises a front axle 26 having two wheel hubs 38, wheel backs 39, tires 40, washers 47, and cap nuts 45. The vehicle also includes a rear axle 18 having two wheel hubs 38, wheel backs 39, tires 40, washers 47 and cap nuts 45. A windshield 41 is mounted on chassis 1, as is a rear bumper 31, a radiator grille 32, a roll bar 33, light bars 34 and 35, an engine 48, an air inlet 49, an exhaust stack 50, and a running board 51.

A sound unit sub-assembly is mounted on chassis 1, and it comprises a speaker housing 3, speaker cover 4, gear plate 19, speaker 5, a speaker cylinder 6 which is sonic or solvent welded into the speaker, a speaker spring 7, a tone arm 20 having a needle 21 mounted therein, a turntable 8 with a turntable shaft 10 and turntable weights 9 and a pinion 11 attached thereto. The sub-assembly also includes a pinion 13 and shaft 12, gear clusters 15 and 14, an axle gear 17 mounted on a rear axle 18, an actuator base 28, holding actuator, shaft 27 with actuator 24 pivotally attached thereto, a front bumper 22 with a bumper guard 23 affixed along with a bumper spring 29. The elements described above are held together by screws 42, 43 and 44. The sound unit is mounted on the chassis by appropriate screws, not shown.

As the vehicle is pushed along a supporting surface, the wheels rotate rear axle 18. Axle gear 17 affixed to rear axle 18 meshes with gear cluster 15 which, in turn, meshes with pinion 13 and pinion 11. Pinion 11 is keyed to turntable shaft 10 which in turn is fixed to turntable 8. Accordingly, as the vehicle is pushed along the supporting surface, the turntable 8 rotates.

The surface of turntable 8 is equipped with three concentric sound tracks, which are machined into the surface. The motor sound track may be machined, for example to simulate the characteristic uneven firing sound of a V-type engine. The machining is carried out by using an estimation of the sound, then cutting a trial record to hear how the system sounds, and then making subsequent revisions to arrive at a sound which simulates the real sound. By this method, a caricature sound may be created. The groove may be wide, at least 0.125 inches, in order to accept blunt needles. The needle is preferably equipped with a spherical end, rather than being sharp as is the case with a usual phonograph needle. This bluntness adds to the life of the turntable surface.

The tone arm 20 with needle 21 riding on the sound tracks of turntable 8 is pivotally fixed to the speaker housing 3 to allow the needle selectively to contact all three of the turntable sound tracks. The other side of the tone arm contacts the speaker cylinder 6. The speaker cylinder 6 and speaker 5 are urged against the tone arm by speaker spring 7. As the needle follows the turntable surface the speaker assembly creates the different sound effects, as shown in FIG. 2.

The front axle functions to change the tone arm location from, for example, the motor sound track to the tire squeal track. Actuator ring 25 is solidly affixed to front axle 26. When the vehicle is moved straight ahead by a forward thrust the actuator ring 25 is in the position shown in FIG. 2, and the tone arm 20 is in a central position in which needle 21 follows the motor sound track on turntable 8. When a side thrust is placed on the vehicle along with a forward thrust, as when the operator is pushing the vehicle and turning the vehicle at the same time, actuator ring 25 acts against either of the two ears shown on actuator 24 in FIG. 2. The actuator 24 pivots around actuator shaft 27 causing front bumper 22 to move back slightly. The front bumper is coupled to the tone arm so that such movement of the front bumper causes the position of the tone arm to shift so as to coincide with the squealing tire track on turntable 8. When the bumper strikes an object, it is deflected toward the center of the vehicle and this, in turn, causes the tone arm to move to coincide with the crash sound track on turntable 8.

The invention provides, therefore, a simple mechanical sound generator which operates in combination with a toy vehicle to emit various sound effects as the vehicle is operated.

It will be appreciated that while a particular embodiment of the invention has been shown and described, modifications may be made. It is intended in the claims to cover all modifications which come within the true spirit and scope of the invention.

I claim:

1. In combination: a vehicle including a rear axle and a forward axle and rear and forward wheels mounted on the respective axles, and an acoustic sound generator mounted on the vehicle, said sound generator includes: a speaker; a moveable tone arm including a needle; a turntable having concentric sound tracks formed thereon; transmission means coupling one of the axles to the turntable to cause the turntable to rotate when the vehicle is propelled with a forward thrust along a support surface; an actuating means coupled to said tone arm to cause said needle to engage different ones of the sound tracks in response to forces and movements of the vehicle during play, said actuating means comprising an actuator mounted on one of the axles and means coupled to the actuator to cause the tone arm to shift the needle from a first to a second of said sound tracks as the vehicle is pushed along the supporting surface with a combined forward thrust and side thrust.

2. The combination defined in claim 1, in which the first sound track causes the speaker to emit sound effects simulating motor noise, and said actuating means responds to the pushing of the toy along the supporting surface by said forward thrust and in the absence of said side thrust to cause the tone arm assembly to place the needle in the first sound track.

3. The combination defined in claim 1, in which the second sound track causes the speaker to emit sounds simulating squealing tires, when said actuating means responds to the biasing of the toy tot he left or right by said side thrust as it is pushed along the supporting surface by said forward thrust to cause the tone arm assembly to place the needle in the second sound track.

4. The combination defined in claim 1, in which said vehicle has a bumper, and in which a third of said sound tracks causes the speaker to emit sounds simulating a crash and in which said actuating means is coupled to said bumper in response to movement of said bumper towards the center of the vehicle to cause the tone arm assembly to place the needle in the third sound track.

* * * * *